US009107522B1

(12) United States Patent
Mauck

(10) Patent No.: US 9,107,522 B1
(45) Date of Patent: Aug. 18, 2015

(54) DISPOSABLE DISH WITH INTEGRAL TRASH BAG

(71) Applicant: Monica L. Mauck, West Jordan, UT (US)

(72) Inventor: Monica L. Mauck, West Jordan, UT (US)

( * ) Notice: Subject to any disclaimer, the term of this patent is extended or adjusted under 35 U.S.C. 154(b) by 0 days.

(21) Appl. No.: 14/182,817

(22) Filed: Feb. 18, 2014

(51) Int. Cl.
*A47G 19/03* (2006.01)
*A47G 19/04* (2006.01)

(52) U.S. Cl.
CPC ..... *A47G 19/03* (2013.01); *A47G 19/04* (2013.01)

(58) Field of Classification Search
CPC ..... A47G 19/03; A47G 19/04
USPC ..... 220/574, 574.3, 737, 495.06, 287, 720, 220/4.01; 383/210, 211, 42
See application file for complete search history.

(56) References Cited

U.S. PATENT DOCUMENTS 2,315,591 A * 4/1943 Carew ..... 220/574.3
4,428,325 A 1/1984 Koch
D330,785 S 11/1992 Jordan
5,553,733 A * 9/1996 Rosenthal ..... 428/35.2
7,051,895 B2 * 5/2006 Toussant et al. ..... 220/287
7,204,202 B2 4/2007 Behun et al.
7,318,534 B2 * 1/2008 Turvey et al. ..... 220/287
7,908,823 B2 * 3/2011 Edmunds ..... 53/287
D663,574 S * 7/2012 Shenkal ..... D7/392.1

* cited by examiner

*Primary Examiner* — Robert J Hicks
*Assistant Examiner* — Kareen Rush
(74) *Attorney, Agent, or Firm* — Crossley Patent Law

(57) ABSTRACT

A disposable dish with integral trash bag devised includes a biodegradable food-receiving element, such as a plate, and a biodegradable disposable cover for the food-receiving element for storage, protection against insects, and reduction of waste. An elastomeric outer edge on the cover continuously releasably attaches to an underside of an outer perimeter of the food-receiving element. A fastener, such as an adhesive, a is disposed on the underside of the outer perimeter. The outer edge is further releasably attached to the fastener. In an unexpanded condition, the cover is removably disposed on and has close-fitting contact with only the bottom surface of the food-receiving element and conforms to the bottom surface to avoid increasing bulk to the food-receiving element. The cover is transformed from the unexpanded condition to an expanded condition to cover only the entire food-receiving element and a food product contained therein.

6 Claims, 3 Drawing Sheets

DISPOSABLE DISH WITH INTEGRAL TRASH BAG

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of food containers are known in the prior art. However, what is needed is a disposable dish with integral trash bag devised to cover a food-receiving element and a food product contained therein with a bag for storage, protection against insects, and also for waste disposal. The instant device includes a biodegradable food-receiving element, such as a plate or a bowl, configured to receive a food product therein and a biodegradable disposable cover for the food-receiving element to reduce waste and promote environmental quality. The cover has an elastomeric outer edge continuously releasably attached to an underside of an outer perimeter of the food-receiving element. A fastener, such as an adhesive, a length of tape, staples, stitches, or combinations thereof, is disposed on the underside of the outer perimeter. The outer edge is further releasably attached to the fastener. The attachment of the cover to the food-receiving element makes the cover readily available for use to protect a food product contained by the food-receiving element from pesky insects and to provide a bag for waste disposal of the food-receiving element, while also accommodating clean up of an area, such as a picnic area or party room, in which the present device is being utilized.

In an unexpanded condition, the cover is removably disposed on and has close-fitting contact with only the bottom surface of the food-receiving element and conforms to the bottom surface to avoid increasing bulk to the food-receiving element. The cover is configured to be transformed from the unexpanded condition on the bottom surface to an expanded condition only upon action by a user to transform the cover from the unexpanded condition to the expanded condition in which the cover is configured to cover only the entire food-receiving element and the food product contained in the food-receiving element in the expanded condition. The cover closely fits the food-receiving element bottom surface in the unexpanded condition to avoid increasing bulk to the food-receiving element.

FIELD OF THE INVENTION

The present invention relates to food containers, and more particularly, to a disposable dish with integral trash bag.

SUMMARY OF THE INVENTION

The general purpose of the present disposable dish with integral trash bag, described subsequently in greater detail, is to provide a disposable dish with integral trash bag which has many novel features that result in a disposable dish with integral trash bag which is not anticipated, rendered obvious, suggested, or even implied by prior art, either alone or in combination thereof.

To accomplish this, the present disposable dish with integral trash bag is devised to cover a food-receiving element and a food product contained therein with a bag for storage, protection against insects, and also for waste disposal. The instant device includes a biodegradable food-receiving element, such as a plate or a bowl, configured to receive a food product therein. The food-receiving element has a top surface, a bottom surface, and an outer perimeter continuously disposed between the top surface and the bottom surface. The outer perimeter has an underside.

A biodegradable disposable cover for the food-receiving element has an elastomeric outer edge continuously releasably attached to the underside of the food-receiving element outer perimeter. A fastener, which is an adhesive, a length of tape, staples, stitches, or combinations thereof, is disposed on the underside of the outer perimeter. The outer edge is further releasably attached to the fastener. The attachment of the cover to the food-receiving element makes the cover readily available for use to protect a food product contained by the food-receiving element from pesky insects and to provide a bag for waste disposal of the food-receiving element, while also accommodating clean up of an area, such as a picnic area or party room, in which the present device is being utilized.

In an unexpanded condition, the cover is removably disposed on and has close-fitting contact with only the bottom surface of the food-receiving element and conforms to the bottom surface. The cover is configured to be transformed from the unexpanded condition on the bottom surface to an expanded condition only upon action by a user to transform the cover from the unexpanded condition to the expanded condition in which the cover is configured to cover only the entire food-receiving element and the food product contained in the food-receiving element in the expanded condition. The cover closely fits the food-receiving element bottom surface in the unexpanded condition to avoid increasing bulk to the food-receiving element.

The food-receiving element in the form of plate preferably has a diameter of approximately 9⅝ inches; however, the food-receiving element can be formed in a wide range of sizes, colors, and design elements. The biodegradable aspect of the food-receiving element and the cover reduces waste and promotes environmental quality. The cover is thin enough to avoid increasing bulk to the food-receiving element, while also accommodating the functions described herein such as food product protection and waste disposal without easily tearing.

Thus has been broadly outlined the more important features of the present disposable dish with integral trash bag so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
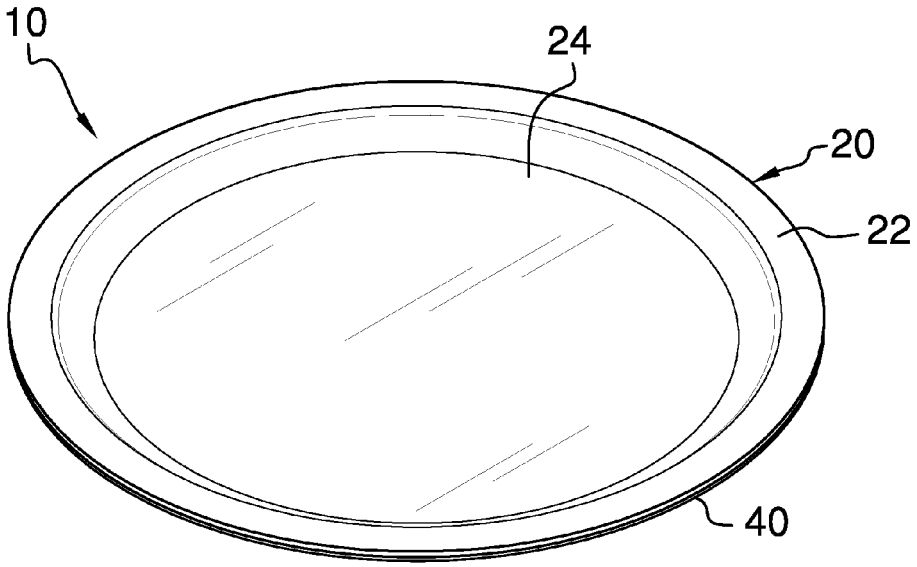
FIG. 1 is an isometric view showing a cover in an unexpanded condition attached to a bottom side of a dish.
Figure 2:
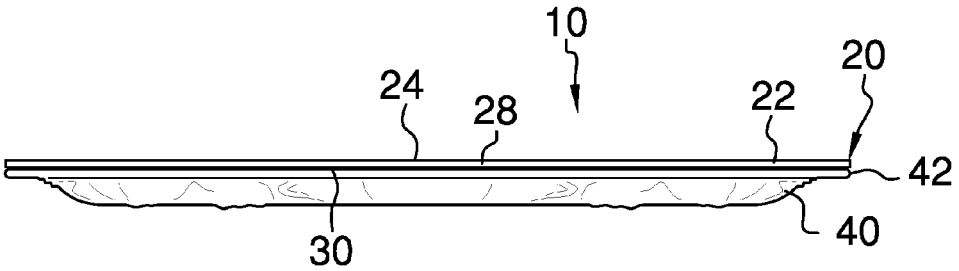
FIG. 2 is a front elevation view.
Figure 3:
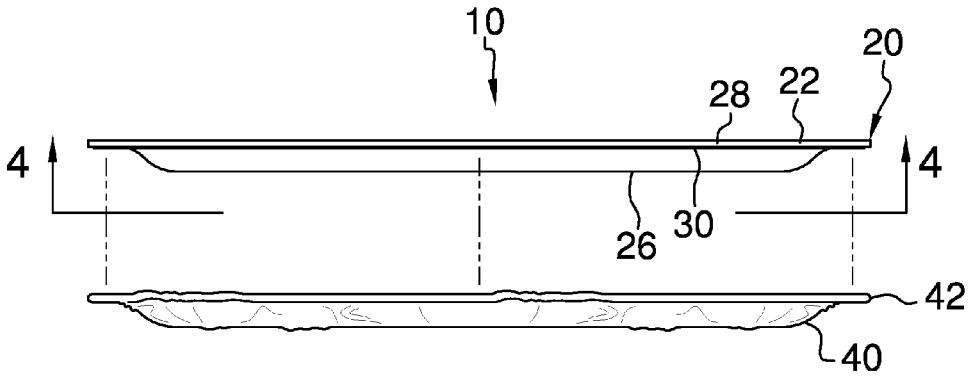
FIG. 3 is an exploded view.
Figure 4:
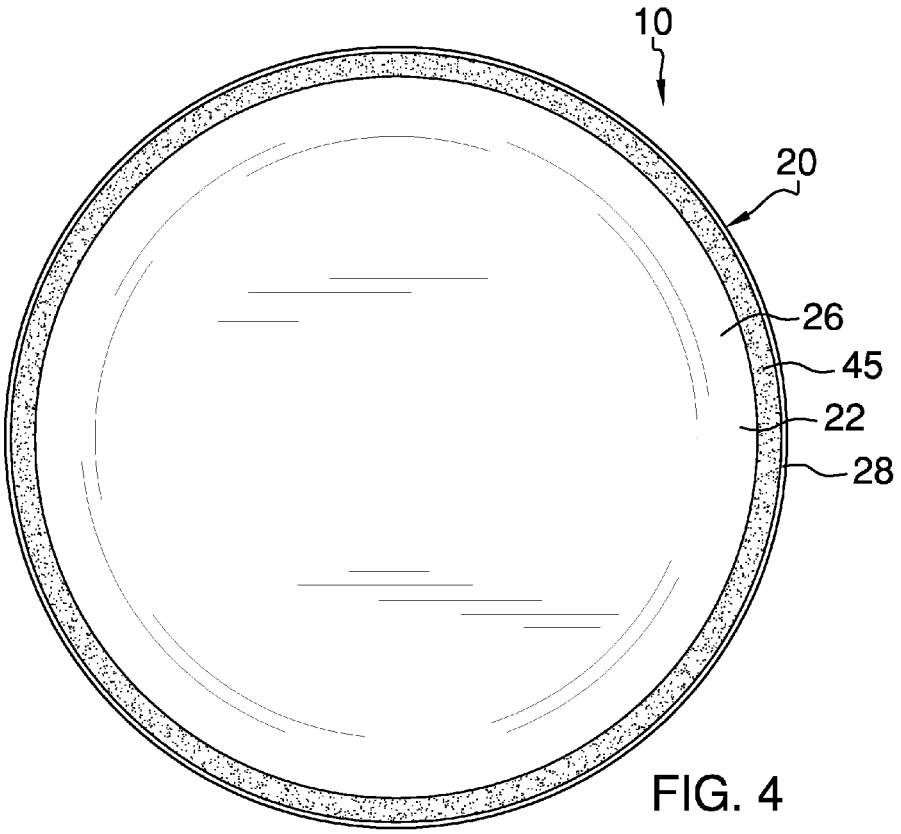
FIG. 4 is a bottom plan view.
Figure 5:
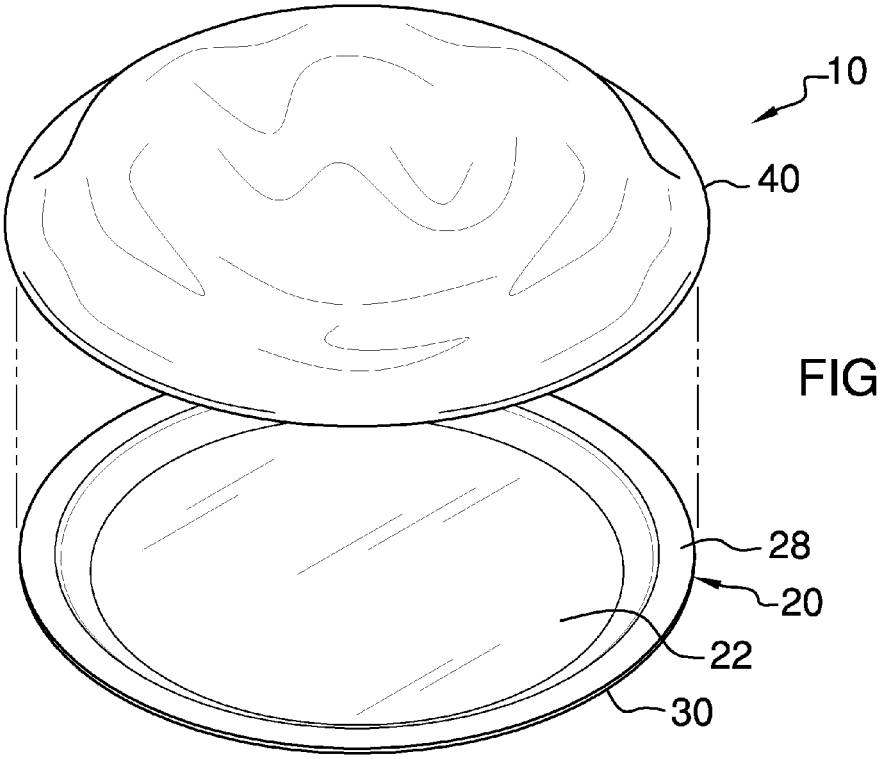
FIG. 5 is an in-use exploded isometric view.
Figure 6:
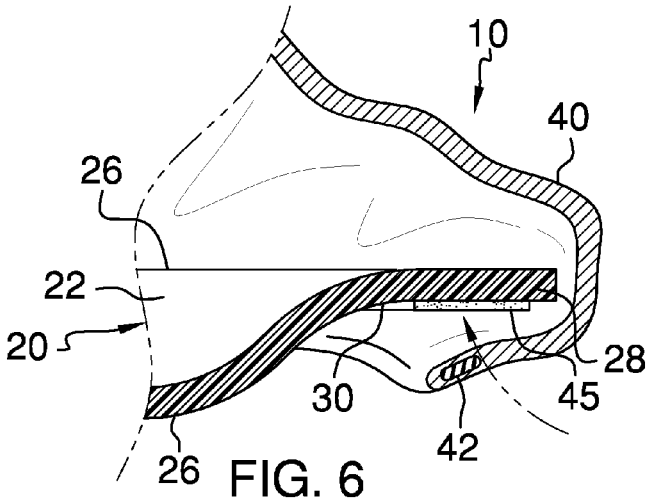
FIG. 6 is an enlarged detail view showing the cover in an expanded condition being attached to a food-receiving element.

With reference now to the drawings, and in particular FIGS. 1 through 6 thereof, an example of the instant disposable dish with integral trash bag employing the principles and concepts of the present disposable dish with integral trash bag and generally designated by the reference number 10 will be described.

Referring to FIGS. 1 through 6, the present disposable dish with integral trash bag 10 devised to cover a food-receiving element 20 and a food product contained therein with a bag for storage, protection against insects, and also for waste disposal is illustrated. The disposable dish with integral trash bag 10 includes a biodegradable food-receiving element 20, such as a plate 22 or a bowl. The food-receiving element 20 is configured to receive a food product therein. The food-receiving element 20 has a top surface 24, a bottom surface 26, and an outer perimeter 28 continuously disposed between the top surface 24 and the bottom surface 26. The outer perimeter 28 has an underside 30.

A biodegradable disposable cover 40 for the food-receiving element 20 has an elastomeric outer edge 42 continuously releasably attached to the underside 30 of the food-receiving element 20 outer perimeter 28. A fastener 45 is disposed on the underside 30 of the outer perimeter 28. The fastener 45 is one of an adhesive, as shown for an example, and alternatively, a length of tape, staples, stitches, and combinations thereof. The outer edge 42 is further releasably attached to the fastener 45. The attachment of the cover 40 to the food-receiving element 20 makes the cover 40 readily available for use to protect a food product contained by the food-receiving element from pesky insects and to provide a bag for waste disposal of the food-receiving element, while also accommodating clean up of an area, such as a picnic area or party room, in which the present device 10 is being utilized.

In an unexpanded condition, the cover 40 is removably disposed on and has close-fitting contact with only the bottom surface 26 of the food-receiving element 20 and conforms to the bottom surface 26. The cover 40 is configured to be transformed from the unexpanded condition on the bottom surface 26 to an expanded condition only upon action by a user to transform the cover 40 from the unexpanded condition to the expanded condition in which the cover 40 is configured to cover only the entire food-receiving element 20 and the food product contained in the food-receiving element 20 in the expanded condition. The cover 40 closely fits the food-receiving element 20 bottom surface 26 in the unexpanded condition to avoid increasing bulk to the food-receiving element 20.

The plate 22 preferably has a diameter of approximately 9⅝ inches. The biodegradable aspect of the food-receiving element 20 and the cover 40 reduces waste and promotes environmental quality.

What is claimed is:

1. A disposable dish with integral trash bag comprising:

a biodegradable food-receiving element configured to contain a food product, the food-receiving element having a top surface, a bottom surface, and an outer perimeter continuously disposed between the top surface and the bottom surface, the outer perimeter having an underside; and a disposable cover having an elastomeric outer edge continuously attached to the underside of the food-receiving element outer perimeter;

wherein the cover is releasably disposed on and has close-fitting contact with only the bottom surface of the food-receiving element in an unexpanded condition;

wherein the cover is configured to be transformed from the unexpanded condition on the bottom surface to an expanded condition only upon action by a user to transform the cover from the unexpanded condition to the expanded condition, wherein the cover is configured to cover only the upper surface of the food-receiving element in the expanded condition; and a fastener disposed on the underside of the outer perimeter;

wherein the outer edge of the cover is further releasably attached to the fastener.

2. The disposable dish with integral trash bag of claim 1 wherein the food-receiving element is a plate.

3. The disposable dish with integral trash bag of claim 1 wherein the fastener is one of an adhesive, a length of tape, staples, stitches, and combinations thereof.

4. A disposable dish with integral trash bag comprising:

a biodegradable food-receiving element configured to contain a food product, the food-receiving element having a top surface, a bottom surface, and an outer perimeter continuously disposed between the top surface and the bottom surface, the outer perimeter having an underside; and a disposable cover having an elastomeric outer edge continuously releasably attached to the underside of the food-receiving element outer perimeter; and a fastener disposed on the underside of the outer perimeter, wherein the fastener is one of an adhesive, a length of tape, staples, stitches, and combinations thereof, wherein the outer edge is further releasably attached to the fastener;

wherein the cover is removably disposed on and has close-fitting contact with only the bottom surface of the food-receiving element and conforms to the bottom surface in an unexpanded condition; and wherein the cover is configured to be transformed from the unexpanded condition on the bottom surface to an expanded condition only upon action by a user to transform the cover from the unexpanded condition to the expanded condition, wherein the cover is configured to cover only the entire food-receiving element and the food product contained in the food-receiving element in the expanded condition.

5. The disposable dish with integral trash bag of claim 4 wherein the food-receiving element is a plate.

6. The disposable dish with integral trash bag of claim 5 wherein the plate has a diameter of approximately 9⅝ inches.

* * * * *